US007606517B2

(12) United States Patent
Kim et al.

(10) Patent No.: US 7,606,517 B2
(45) Date of Patent: Oct. 20, 2009

(54) IMAGE FORMING APPARATUS HAVING A POWER CONTROLLING DEVICE THAT CONTROLS POWER SUPPLIED TO DEVELOPERS

(75) Inventors: Sung-dae Kim, Suwon-si (KR); Cheol-young Han, Yongin-si (KR); Young-min Yoon, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 436 days.

(21) Appl. No.: 11/342,634

(22) Filed: Jan. 31, 2006

(65) Prior Publication Data

US 2006/0238783 A1 Oct. 26, 2006

(30) Foreign Application Priority Data

Apr. 20, 2005 (KR) ..... 10-2005-0032764

(51) Int. Cl.
*G03G 15/08* (2006.01)

(52) U.S. Cl. ..... 399/228

(58) Field of Classification Search ..... 399/54, 399/223, 225, 228

See application file for complete search history.

(56) References Cited

U.S. PATENT DOCUMENTS 5,168,319 A 12/1992 Kimura et al.
5,495,327 A * 2/1996 Inomata ..... 399/228
5,521,693 A * 5/1996 Kojima et al. ..... 399/228
5,585,898 A * 12/1996 Fujii ..... 399/228
5,666,613 A 9/1997 Kumon et al.
6,522,850 B2 2/2003 Hiroki
6,748,188 B2 6/2004 Kishigami et al.
6,778,798 B2 * 8/2004 Kitahara ..... 399/228
7,020,409 B2 * 3/2006 Kim ..... 399/88
7,376,373 B2 * 5/2008 Kim et al. ..... 399/228

FOREIGN PATENT DOCUMENTS

JP 08-095338 4/1996
JP 10-148985 6/1998
JP 2002-099129 4/2002

* cited by examiner

*Primary Examiner*—Robert Beatty
(74) *Attorney, Agent, or Firm*—Roylance, Abrams, Berdo & Goodman, LLP

(57) ABSTRACT

Provided is an image forming apparatus for printing a desired image. The image forming apparatus comprises a first developing unit comprising a first fixed power transmission unit, a second developing unit comprising a second fixed power transmission unit, a first sliding power transmission unit comprising a first interconnection portion placed slidably along a first axis of the first fixed power transmission unit, a second sliding power transmission unit comprising a second interconnection portion placed slidably along a second axis of the second fixed power transmission unit, and a clutching unit comprising a rotating element having a plurality of pushing bosses protruding towards at least one of the first and second sliding power transmission units, at least one of the pushing bosses selectively contacting at least one of the first and second sliding power transmission units when the rotating element is rotated, so that at least one of the first and second sliding power transmission units is slid towards at least one of the first and second fixed power transmission units to couple with or separate from at least one of the first and second fixed power transmission units, respectively.

9 Claims, 6 Drawing Sheets

IMAGE FORMING APPARATUS HAVING A POWER CONTROLLING DEVICE THAT CONTROLS POWER SUPPLIED TO DEVELOPERS

BACKGROUND OF THE INVENTION

This application claims the benefit under 35 U.S.C. §119 (a) of Korean Patent Application No. 10-2005-0032764, filed on Apr. 20, 2005 in the Korean Intellectual Property Office, the entire disclosure of which is hereby incorporated by reference.

1. Field of the Invention

The present invention relates to an image forming apparatus. More particularly, the present invention relates to an image forming apparatus having a power controlling device that controls power supplied to a plurality of color developers.

2. Description of the Related Art

Image forming apparatuses print a desired image by receiving a digital image signal and forming an electrostatic latent image on a photosensitive medium coated with a conductive material by using an exposure unit such as a laser scanning unit. The electrostatic latent image is develop into a toner image using toner by transferring the toner image to a recording medium, and fusing the toner image on the recording medium by applying heat and pressure thereto.

Image forming apparatuses generally are classified into dry and wet apparatuses according to a state of toner and carrier being used. Furthermore, the dry apparatuses can be classified into a 1-component developing unit and a 2-component developing unit.

In the 1-component developing unit, an image is formed using only toner. In the 2-component developing unit, an image is formed using a mixture of toner.

In the 1-component developing unit, the toner is provided to the photosensitive medium to develop the toner image. The toner remaining on a surface of the photosensitive medium is removed by a cleaning blade and collected by a collecting unit for reuse. In the 2-component developing unit, the carrier is collected without being provided to the photosensitive medium and only the toner particles are provided to the photosensitive medium to develop the toner image. As a result, the toner particles remaining on the surface of the photosensitive medium are removed by the cleaning blade and collected by the collecting unit for reuse. The above descriptions relate to a case of forming a black and white image. It is difficult to reuse the toner remaining on the photosensitive medium when a color image is formed, because a color toner image on the surface of the photosensitive medium is a mixture of toners of various colors.

In order to form a color image, an image forming apparatus needs four toner cartridges, such as, yellow (Y), magenta (M), cyan (C), and black (K). Developing rollers provided in each of the four toner cartridges supply toners to an electrostatic latent image formed on a photosensitive medium, and develops the electrostatic latent image into a toner image by supplying the toners to the electrostatic latent image.

The developing rollers provided in each of the four toner cartridges are actuated by a driving motor. Since the developing rollers do not need to operate simultaneously, an electrical clutch is used to power the developing rollers selectively.

However, such electrical clutch is expensive and increases the overall size of the image forming apparatus. In addition, the electrical clutch frequently malfunctions and does not operate precisely.

Accordingly, there is a need for an improved image forming apparatus that is reduced in size and has a power controlling device that controls power to the toner cartridges.

SUMMARY OF THE INVENTION

An aspect of embodiments of the present invention is to address at least the above problems and/or disadvantages and to provide at least the advantages described below. Accordingly, an aspect of embodiments of the present invention is to provide an image forming apparatus including a power controlling device that can more timely and precisely control a developing roller.

According to an aspect of the present invention, there is provided an image forming apparatus, the image forming apparatus comprising: a first developing unit comprising a first fixed power transmission unit; a second developing unit comprising a second fixed power transmission unit; a first sliding power transmission unit comprising a first interconnection portion placed slidably along a first axis of the first fixed power transmission unit; a second sliding power transmission unit comprising a second interconnection portion placed slidably along a second axis of the second fixed power transmission unit; and a clutching unit comprising a rotating element having a plurality of pushing bosses protruding towards at least one of the first and second sliding power transmission units, at least one of the pushing bosses selectively contacting at least one of the first and second sliding power transmission units when the rotating element is rotated, so that at least one of the first and second sliding power transmission units is slid towards at least one of the first and second fixed power transmission units to couple with or separate from at least one of the first and second fixed power transmission units, respectively.

Other objects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
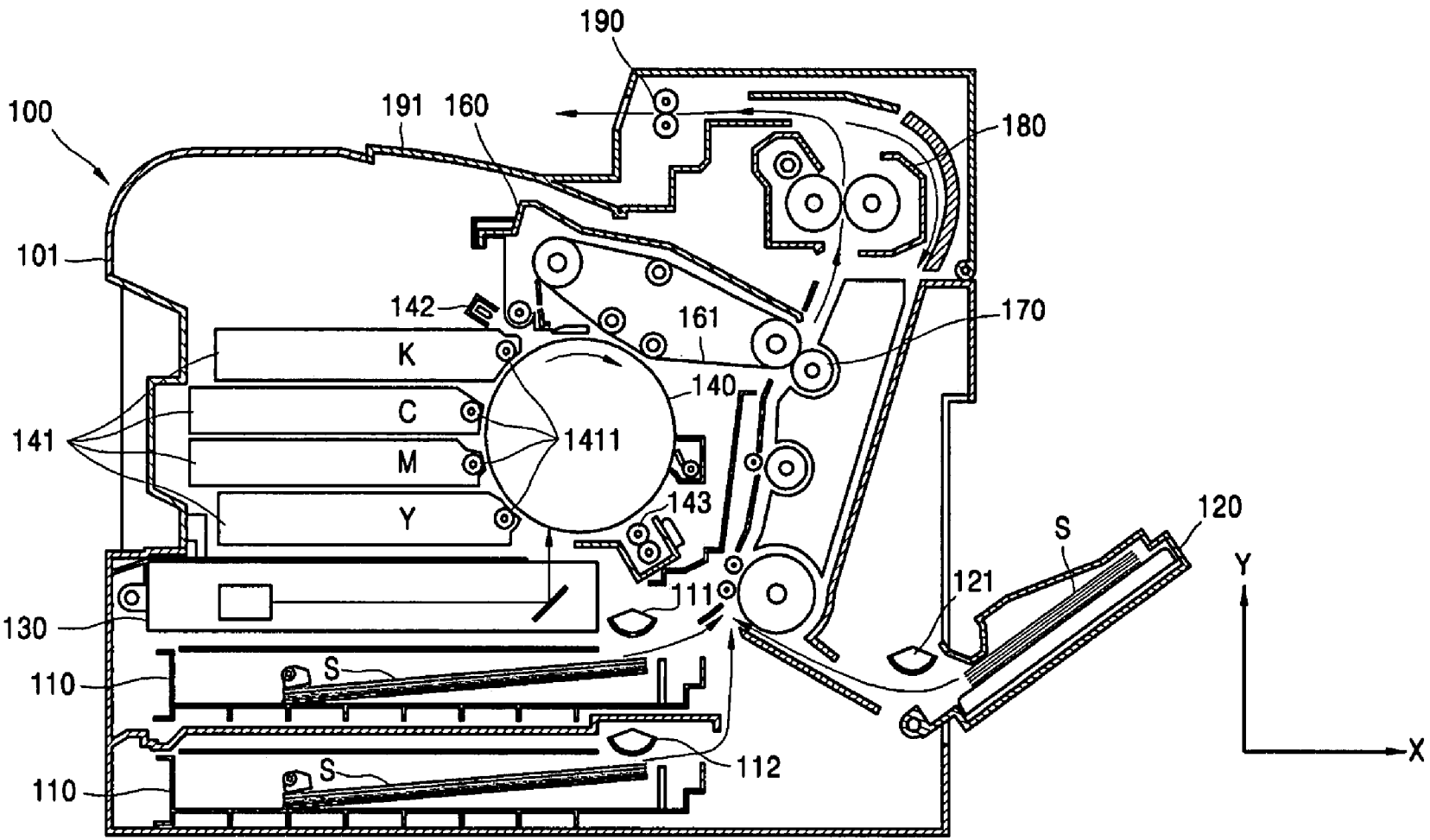
FIG. 1 is a schematic diagram of an image forming apparatus using a power controlling device according to an exemplary embodiment of the present invention.

Referring to FIG. 1, an image forming apparatus 100, according to an exemplary embodiment of the present invention, includes paper cassettes 110, an exposure unit 130, a photosensitive drum 140, black 141K, cyan 141C, magenta 141M, and yellow 141Y color developing units, an intermediate transfer unit 160, a transfer roller 170, a fusing unit 180, and a paper eject unit 190.

The paper cassettes 110 store sheets of printing paper S and are detachably installed in a main body 101. Pickup rollers 111 and 112, which pick up the printing paper S one by one, are rotatably installed in the main body 101 above the paper cassettes 110, respectively. Reference number 120 includes a multi-purpose paper stacking tray which stores sheets of printing paper S. The multi-purpose paper stacking tray 120 is pivotably installed to the main body 101 and in an exemplary implementation folds in and out, with respect to the main body 101. A pickup roller 121, which picks up the sheets of printing paper S one by one, is installed above the multi-purpose paper stacking tray 120.

The exposure unit 130 emits a ray, corresponding to image information, onto the photosensitive drum 140 charged with a uniform electrostatic potential in order to form an electrostatic latent image thereon.

An optical conductive layer is formed on an outer circumference of the photosensitive drum 140, which is cylindrical in shape and made of metal.

The black 141K, cyan 141C, magenta 141M, and yellow 141Y color developing units each include solid powder toners of black K, cyan C, magenta M, and yellow Y colors. The black 141K, cyan 141C, magenta 141M, and yellow 141Y color developing units each include developing rollers 1411 for supplying the toners to the electrostatic latent image formed on the photosensitive drum 140 in order to form a toner image. The black 141K, cyan 141C, magenta 141M, and yellow 141Y color developing units are installed so that the developing rollers 1411 are a predetermined distance away from the outer circumference of the photosensitive drum 140.

The transfer roller 170 is installed in the main body 101 facing a transfer belt 161. The transfer roller 170 separates from the transfer belt 161 when a color toner image transfers to the transfer belt 161. After the color toner image is completely transferred to the transfer belt 161, the transfer roller 170 provides the transfer belt 161 with a predetermined pressure in order to transfer the color toner image onto the printing paper S.

The fusing unit 180 includes a pair of rollers that are meshed with each other. The fusing unit 180 heats and applies pressure to the color toner image in order to fuse and fix the color toner image on the printing paper S passing therebetween. A heating element (not shown) may be installed on one or both rollers.

The paper eject unit 190 includes a pair of rollers for ejecting the printing paper S in which the color toner image is formed, and pile the sheets of printing paper S in an exit tray 191.

A charging roller 143 charges the photosensitive drum 140 with a uniform electrostatic potential. The charging roller 143 rotates while making or not making contact with the outer circumference of the photosensitive drum 140, and supplies electric charges to uniformly charge the outer circumference of the photosensitive drum 140.

A pre-transfer eraser 142 removes charges in a region where the toner image on the photosensitive drum 140 is not formed (that is, a non-image region).

Figure 2:
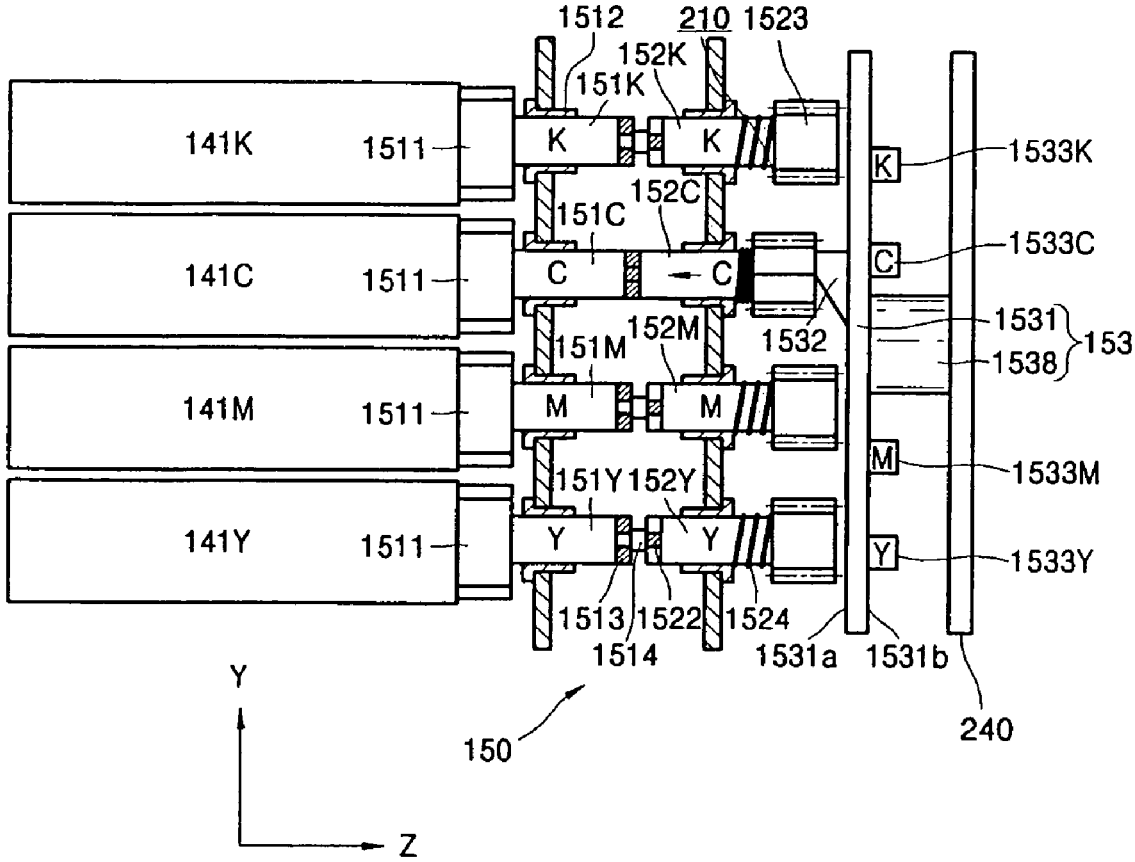
FIG. 2 is a diagram illustrating a power transmission process of the power controlling device of FIG. 1 according to an exemplary embodiment of the present invention.

Referring to FIG. 2, the image forming apparatus 100 includes a power controlling device 150 for selectively transmitting power to the black 141K, cyan 141C, magenta 141M, and yellow 141Y color developing units.

The power controlling device 150 includes black 151K, cyan 151C, magenta 151M, and yellow 151Y color fixed power transmission units; black 152K, cyan 152C, magenta 152M, and yellow 152Y sliding power transmission units; and a clutching unit 153.

The black 151K, cyan 151C, magenta 151M, and yellow 151Y color fixed power transmission units are rotatably installed on the main body 101 via bushings 1512, and each includes a developing roller driving gear 1511. The black 151K, cyan 151C, magenta 151M, and yellow 151Y color fixed power transmission units are respectively connected to the black 152K, cyan 152C, magenta 152M, and yellow 152Y color sliding power transmission units via axes 1514. A plurality of claws 1513 are respectively formed on the side of the black 151K, cyan 151C, magenta 151M, and yellow 151Y color fixed power transmission units. Each of the plurality of claws 1513 face the black 152K, cyan 152C, magenta 152M, and yellow 152Y color sliding power transmission units. The plurality of claws 1513 are formed to, for example, interconnect with claws 1522 formed on an end of the black 152K, cyan 152C, magenta 152M, and yellow 152Y color sliding power transmission units so that they can mesh with each other and transmit rotation power to the black 152K, cyan 152C, magenta 152M, and yellow 152Y color sliding power transmission units. The claws 1513 and 1522 are exemplary elements for transmitting power. However other elements that interconnect can be used for transmitting power.

Figure 3:
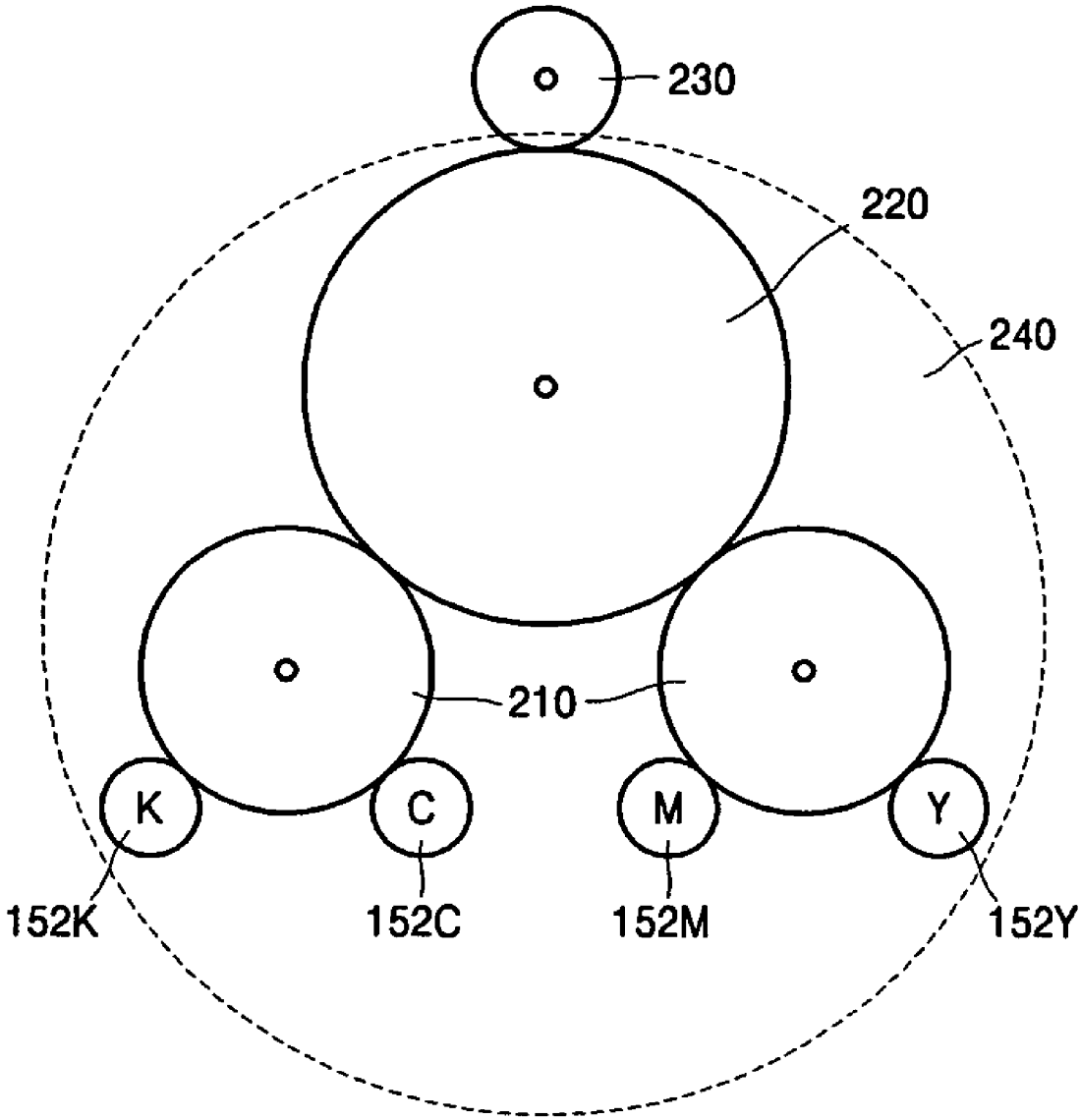
FIG. 3 is a side view of the power controlling device in FIG. 2.

The black 152K, cyan 152C, magenta 152M, and yellow 152Y color sliding power transmission units are installed in the main body 101 via bushings 1512 to, for example, slide in a Z direction along the axes 1514. Passive gears 1523 are each placed at a side of the black 152K, cyan 152C, magenta 152M, and yellow 152Y color sliding power transmission units facing the clutching unit 153 to be connected to power transmitting gears 210 installed in the main body 101, as illustrated in FIG. 3. The power transmitting gears 210 receive power from a driving source 230 and a second power transmitting gear 220. When the driving source 230 operates, the power transmitting gears 210 also rotate, thereby rotating each of the passive gears 1523 of the black 152K, cyan 152C, magenta 152M, and yellow 152Y color sliding power transmission units.

While the power transmitting gears 210 and the passive gears 1532 are connected to each other, the passive gears 1523 may slide, for example, while making contact with the power transmitting gears 210. Therefore, the power transmitting gears 210 and the passive gears 1532 may be spur gears.

The black 152K, cyan 152C, magenta 152M, and yellow 152Y color sliding power transmission units may apply elastic forces towards the clutching unit 153 via elastic members 1524 placed on each of the black 152K, cyan 152C, magenta 152M, and yellow 152Y color sliding power transmission units. After the black 152K, cyan 152C, magenta 152M, and yellow 152Y color sliding power transmission units are respectively coupled with the black 151K, cyan 151C, magenta 151M, and yellow 151Y color fixed power transmission units, each of the color sliding power transmission units separates from the clutching unit 153 by the elastic forces of the elastic members 1524 and then returns to an original position.

Referring to FIGS. 2 through 5, the clutching unit 153 selectively couples the black 152K, cyan 152C, magenta 152M, and yellow 152Y color sliding power transmission units with the black 151K, cyan 151C, magenta 151M, and yellow 151Y color fixed power transmission units. The clutching unit 153 includes a rotating element 1531, a pushing boss 1532, black 1533K, cyan 1533C, magenta 1533M, and yellow 1533Y color location setting hooks or devices, a home position hook or device 1534, and an actuator 1535. As applied to elements 1533 and 1534, the term "hook(s)" shall be understood to be interchangeable with "device(s)".

The rotating element 1531 is rotatably installed in the main body 101, and is connected to a power transmitting gear 240 that is connected to power from the driving source 230. The power transmitted to the rotating element 1531 can be blocked by a clutch 1538 installed between the rotating element 1531 and the power transmitting gear 240. The rotating element 1531 rotates by receiving the power transmitted from the driving source 230 via the clutch 1538. Therefore, the rotating element 1531 rotates when the driving source 230 operates unless an external torque is applied.

Figure 4:
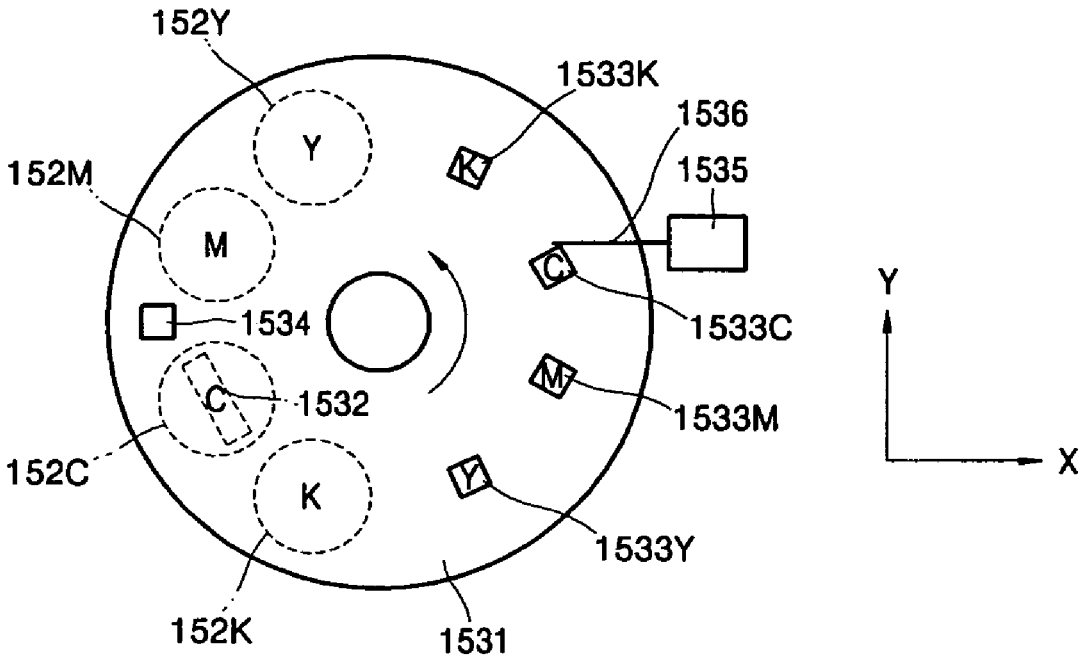
FIG. 4 is a plane view of a clutching unit illustrated in FIG. 3.
Figure 5:
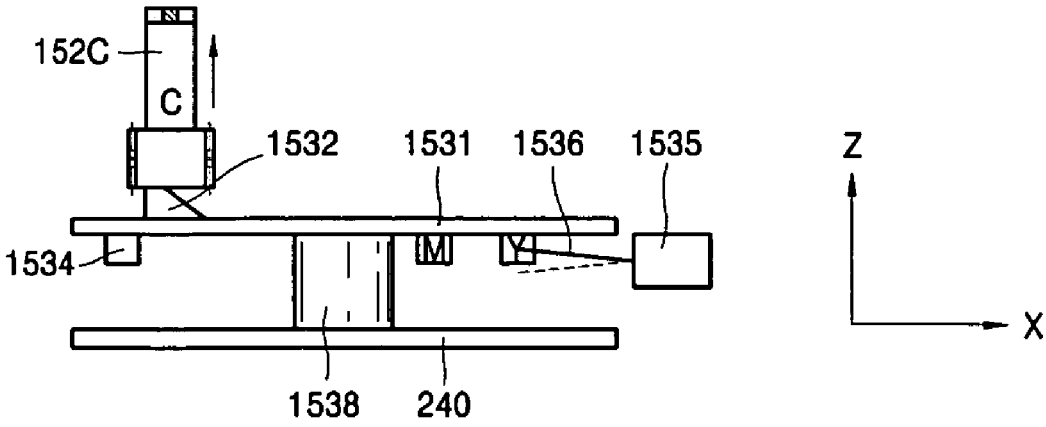
FIG. 5 is a side view of the clutching unit illustrated in FIG. 3.

The clutch 1538 preferably transmits power in only one direction. Thus, the clutch 1538 transmits power so that the rotating element 1531 rotates preferably in an anti-clockwise direction as illustrated in FIG. 4. If the rotating element 1531 needs to rotate in a clockwise direction, a clutch can be used that transmits the power preferably in the clockwise direction.

The pushing boss 1532 protrudes from a surface 1531*a* of the rotating element 1531 facing the black 152K, cyan 152C, magenta 152M, and yellow 152Y color sliding power transmission units. When the rotating element 1531 rotates, the pushing boss 1532 comes in contact with a bottom surface of one of the passive gears 1523. The pushing boss 1532 then pushes one of the black 152K, cyan 152C, magenta 152M, or yellow 152Y color sliding power transmission units towards a corresponding black 151K, cyan 151C, magenta 151M, or yellow 151Y color fixed power transmission units to connect the corresponding color sliding power transmission units and color fixed power transmission units together. Accordingly, power is transmitted from one of the black 152K, cyan 152C, magenta 152M, or yellow 152Y color sliding power transmission units to the corresponding black 151K, cyan 151C, magenta 151M, or yellow 151Y color fixed power transmission units. One side of the pushing boss 1532 may be slanted to easily come in contact with the bottom surface of the passive gear 1523.

The black 1533K, cyan 1533C, magenta 1533M, and yellow 1533Y color location setting devices protrude from a surface 1531*b* connected to the clutch 1538 at predetermined intervals to correspond to the black 152K, cyan 152C, magenta 152M, and yellow 152Y color sliding power transmission units. The black 1533K, cyan 1533C, magenta 1533M, and yellow 1533Y color location setting devices control the position of the pushing boss 1532 together with the actuator 1535 so that the pushing boss 1532 contacts one of the black 152K, cyan 152C, magenta 152M, or yellow 152Y color sliding power transmission units in order to connect with one of the corresponding black 151K, cyan 151C, magenta 151M, or yellow 151Y color fixed power transmission units.

Similarly to the black 1533K, cyan 1533C, magenta 1533M, and yellow 1533Y color location setting devices, the home position hook 1534 protrudes from the surface 1531*b*, which is connected to the clutch 1538. The home position device 1534 controls the position of the pushing boss 1532 together with the actuator 1535. As a result, the pushing boss 1532 is located in a home position and does not make contact with any one of the black 152K, cyan 152C, magenta 152M, or yellow 152Y color sliding power transmission units.

The actuator 1535, installed in the main body 101, ascends and descends an actuator arm 1536 in the Z direction in order to lock the rotating element 1531 by contacting one of the black 1533K, cyan 1533C, magenta 1533M, or yellow 1533Y color location setting devices, and the home position device 1534.

Figure 6:
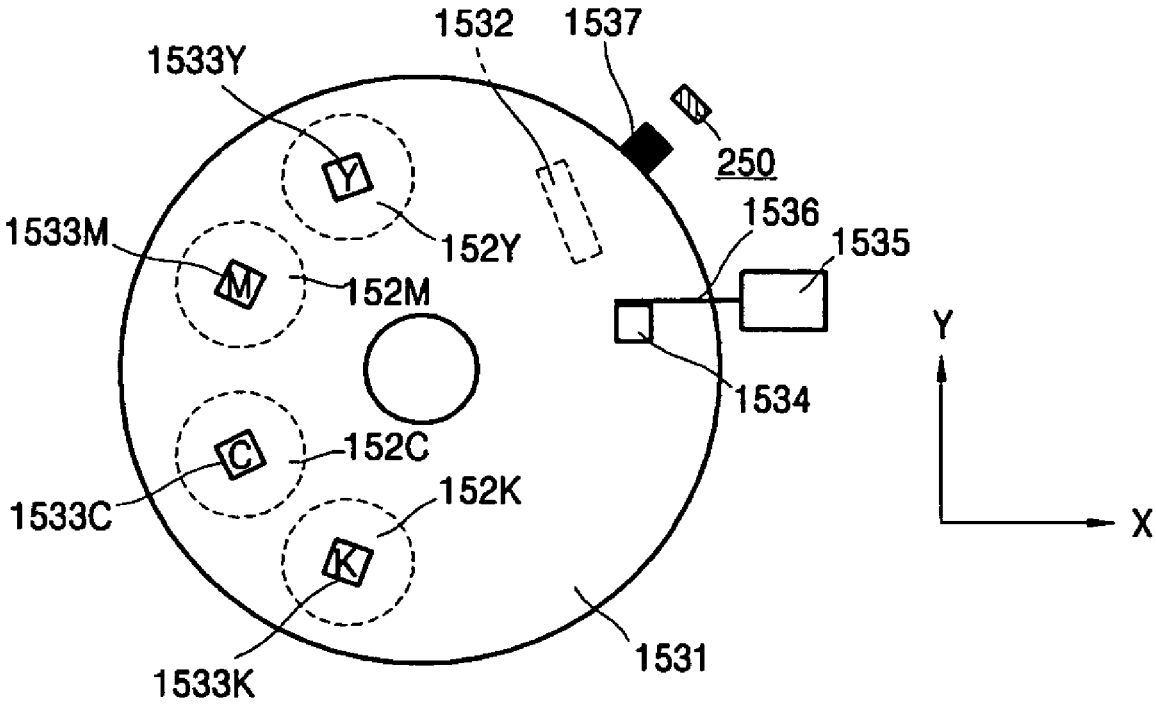
FIG. 6 is a plane view of a clutching unit according to an exemplary embodiment of the present invention placed in a home position.

Referring to FIG. 6, the clutching unit 153 further includes a home position mark 1537 formed on the rotating element 1531 and a sensor 250. The home position mark 1537 indicates the home position of the pushing boss 1532 in order to help locate where the pushing boss 1532 does not make contact with any one of the black 152K, cyan 152C, magenta 152M, and yellow 152Y color sliding power transmission units. The sensor 250 installed in the main body 101 senses the home position mark 1537.

When the sensor 250 senses the home position mark 1537, the actuator 1535 contacts the home position device 1534 and locks the rotating element 1531. As a result, the pushing boss 1532 is located in the home position, not contacting any of the black 152K, cyan 152C, magenta 152M, and yellow 152Y color sliding power transmission units.

The following is a description of the operation of the power controlling device 150 having the above-described structure.

Referring to FIG. 1, when the black 141K, cyan 141C, magenta 141M, and yellow 141Y color developing units are installed in the main body 101, the corresponding color developing units are respectively connected to the developing roller driving gears 1511.

Referring to FIGS. 2 through 6, the black 152K, cyan 152C, magenta 152M, and yellow 152Y color sliding power transmission units rotate in connection with the passive gears 1523. Before the electrostatic latent image is developed, the home position device 1534 contacts the actuator arm 1536. In this instance, the rotating element 1531 is locked by the actuator arm 1536 and power is not transmitted to the rotating element 1531. Additionally, the pushing boss 1532 does not contact any one of the black 152K, cyan 152C, magenta 152M, or yellow 152Y color sliding power transmission units, and thus power is not transmitted to any one of the color sliding power transmission units.

In order to transmit power to the cyan color developing unit 141C to print a cyan color image, the actuator arm 1536 contacts the cyan color location setting device 1533C and locks the rotation of the rotating element 1531 while the pushing boss 1532 contacts the cyan sliding power transmission unit 152C, as illustrated in FIG. 4. The cyan color sliding power transmission unit 152C slides in the Z direction along the axis 1514 and connects the cyan color fixed power transmission unit 151C, thereby transmitting the rotation power of the cyan color sliding power transmission unit 152C to the cyan color fixed power transmission unit 151C. Thereafter, the cyan color developing roller 141C, as shown in FIG. 1, contacts the photosensitive drum 140 and the electrostatic latent image formed on the outer circumference of the photosensitive drum 140 is developed into the cyan color image.

As described above, when the actuator arm 1536 contacts the cyan color location setting device 1533C, the clutch 1538 blocks the rotation power of the power transmitting gear 240.

In order to develop a magenta color image after developing the electrostatic latent image into the cyan color image, the actuator arm 1536 unlocks the cyan color location setting device 1533C and locks the magenta color location setting device 1533M. Then, consistent with operations for developing the cyan color image as described above, the magenta color sliding power transmission unit 152M contacts the magenta color fixed power transmission unit 151M, as shown in FIG. 1, to transmit power. Accordingly, the electrostatic latent image is developed into the magenta color image.

A black color image and a yellow color image are developed by repeating the same operations described above.

When the printing operation restarts, after the developing of the electrostatic latent image is completed or power of the image forming apparatus 100 is turned off, the sensor 250 senses the home position mark 1537 and the actuator arm 1536 locks the home position device 1534, thereby locating the pushing boss 1532 in the home position.

Figure 7:
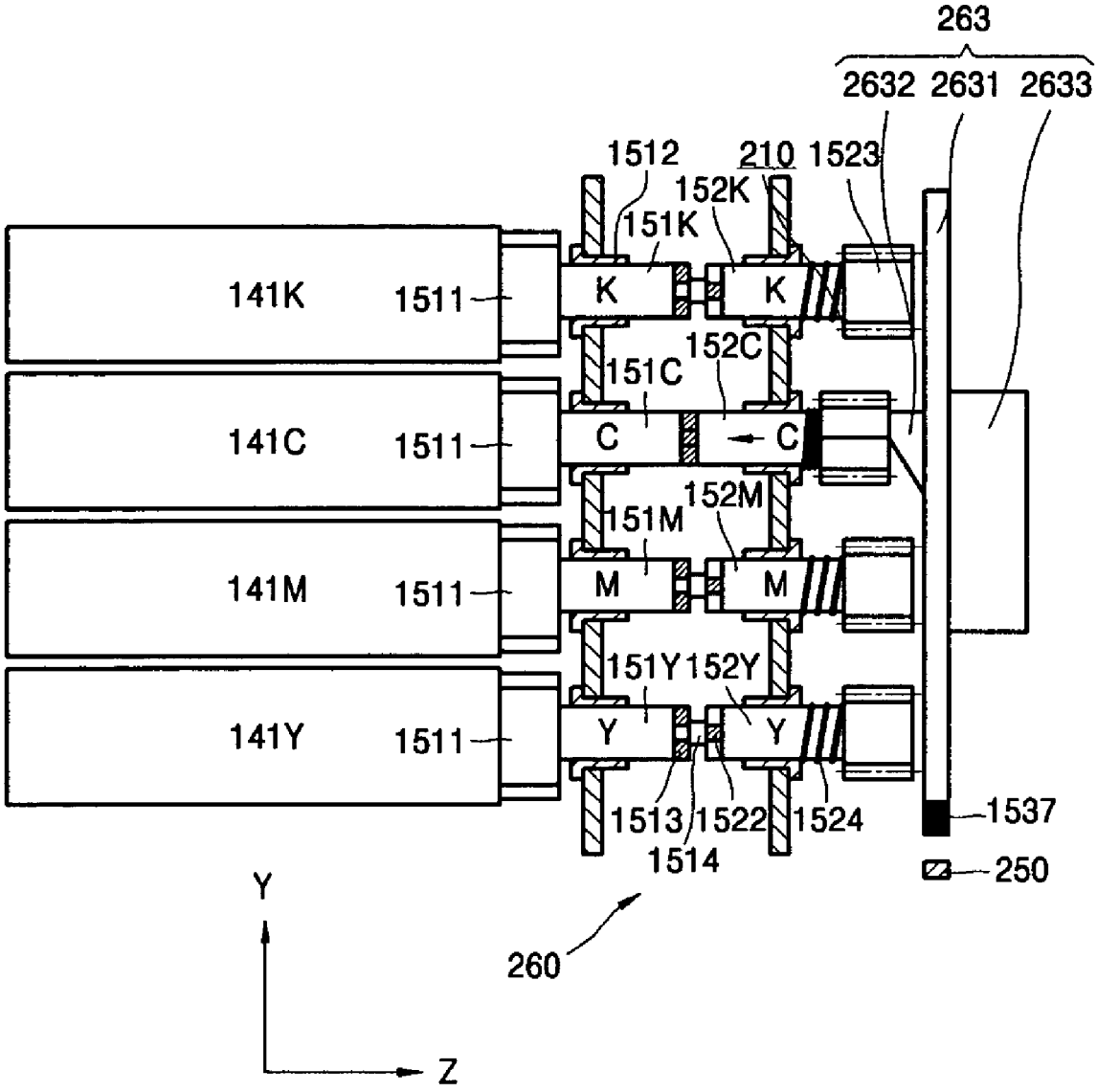
FIG. 7 is a side view of a power controlling device according to an exemplary embodiment of the present invention.

Referring to FIG. 7, a power controlling device 260, according to an exemplary embodiment of the present invention, has a similar structure with the power controlling device 150 of an exemplary embodiment. The power controlling device 260 includes black 151K, cyan 151C, magenta 151M, and yellow 151Y color fixed power transmission units; and black 152K, cyan 152C, magenta 152M, and yellow 152Y color sliding power transmission units. The power controlling device 260 includes a clutching unit 263.

The clutching unit 263 includes a rotatably installed rotating element 2631, and a pushing boss 2632 protruding from a surface of the rotating element 2631 facing the black 152K, cyan 152C, magenta 152M, and yellow 152Y color sliding power transmission units. The clutching unit further includes a motor 2633 for rotating the rotating element 2631 so that the pushing boss 2632 contacts one of the black 152K, cyan 152C, magenta 152M, or yellow 152Y color sliding power transmission units.

Passive gears 1523 rotate in connection with a driving source 230 and power transmitted gears 210 and 220, as illustrated in FIG. 3. The rotating element 2631 is rotated by a separate motor 2633. Accordingly, the rotating element 2631 and the black 152K, cyan 152C, magenta 152M, and yellow 152Y color sliding power transmission units are operated by different power sources.

The clutching unit 263 further includes a home position mark 1537 and a sensor 250. The home position mark 1537 formed on the rotating element 2631 indicates a home position of the pushing boss 2632 in order to help locate where the pushing boss 2632 does not contact any one of the black 152K, cyan 152C, magenta 152M, or yellow 152Y color sliding power transmission units. The sensor 250 installed in the main body 101 senses the home position mark 1537.

When the sensor 250 senses the home position mark 1537, the motor 2633 rotates the rotating element 2631 so that the pushing boss 2632 is placed in the home position, and makes no contact with the black 152K, cyan 152C, magenta 152M, and yellow 152Y color sliding power transmission units.

A description of the operations of the power controlling device 260 will be omitted in exemplary embodiments of the present invention since the power controlling device 260 functions similarly to the power controlling device 150 described previously.

As described above, an image forming apparatus according to exemplary embodiments of the present invention has improved reliability since power is transmitted via the meshed fixed power transmission units and sliding power transmission units, and the fixed power transmission units and sliding power transmission units make contact with each other without slipping.

While the invention has been shown and described with reference to exemplary embodiments thereof, it will be understood by those skilled in the art that various changes in form and details may be made therein without departing from the spirit and scope of the present invention as defined by the appended claims.

What is claimed is:

1. An image forming apparatus comprising:

a first developing unit comprising a first fixed power transmission unit;

a second developing unit comprising a second fixed power transmission unit;

a first sliding power transmission unit comprising a first interconnection portion placed slidably along a first axis of the first fixed power transmission unit;

a second sliding power transmission unit comprising a second interconnection portion placed slidably along a second axis of the second fixed power transmission unit; and a clutching unit comprising a rotating element having a pushing boss protruding towards at least one of the first and second sliding power transmission units, the pushing boss selectively contacting at least one of the first and second sliding power transmission units when the rotating element is rotated, so that at least one of the first and second sliding power transmission units is slid towards at least one of the first and second fixed power transmission units to couple with or separate from at least one of the first and second fixed power transmission units, respectively.

2. The image forming apparatus of claim 1, further comprising an elastic member that applies elastic force to the first sliding power transmission unit in a direction in which the first sliding power transmission unit is separated from the first fixed power transmission unit, wherein the clutching unit slides the first sliding power transmission unit in a direction in which the elastic member is pressurized in order to couple the first sliding power transmission unit and the first fixed power transmission unit.

3. The image forming apparatus of claim 2, wherein the clutching unit further comprises a clutch for transmitting power to the rotating element.

4. The image forming apparatus of claim 3, wherein the rotating element further comprises a first location setting device corresponding to the first sliding power transmission unit and a second location setting device corresponding to the second sliding power transmission unit, the clutching unit further comprising:

an actuator that is selectively coupled to at least one of the first and second location setting devices, wherein the clutch blocks power transmitted to the rotating element when the actuator is coupled to the at least one of the first and second location setting devices.

5. The image forming apparatus of claim 4, wherein the rotating element further comprises a home position device, and wherein the clutch blocks the transmitted power, and positions the pushing boss in a home position when the actuator is coupled to the home position device.

6. The image forming apparatus of claim 5, wherein the rotating element further comprises a home position mark, and the clutching unit further comprises:

a sensor for sensing the home position mark, wherein the actuator is coupled to the home position device when the sensor senses the home position mark.

7. The image forming apparatus of claim 2, wherein the clutching unit comprises a motor for rotating the rotating element, whereby the pushing boss selectively pushes at least one of the first and second sliding power transmission units.

8. The image forming apparatus of claim 7, wherein the rotating element comprises a home position mark, and the clutching unit further comprising:

a sensor for sensing the home position mark, wherein the rotating element operates so that the pushing boss is positioned in a home position when the sensor senses the home position mark.

9. The image forming apparatus of claim 1, further comprising a power controller for controlling power to the first and second developing units, wherein the power controller comprises the first and second fixed power transmission units, the first and second sliding hubs, and the clutching unit.

* * * * *

UNITED STATES PATENT AND TRADEMARK OFFICE

CERTIFICATE OF CORRECTION

PATENT NO. : 7,606,517 B2
APPLICATION NO. : 11/342634
DATED : October 20, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 698 days.

Signed and Sealed this

Twelfth Day of October, 2010

David J. Kappos

David J. Kappos
*Director of the United States Patent and Trademark Office*